US011444378B2

(12) United States Patent
Canete Cabeza et al.

(10) Patent No.: US 11,444,378 B2
(45) Date of Patent: Sep. 13, 2022

(54) MULTIBAND 3D UNIVERSAL ANTENNA

(71) Applicant: PREMO, S.A., Campanillas (ES)

(72) Inventors: Claudio Canete Cabeza, Benalmadena (ES); Maria del Mar Villarrubia Garcia, Malaga (ES); Francisco Ezequiel Navarro Perez, Barcelona (ES)

(73) Assignee: PREMO, S.A., Campanillas (ES)

( * ) Notice: Subject to any disclaimer, the term of this patent is extended or adjusted under 35 U.S.C. 154(b) by 0 days.

(21) Appl. No.: 17/128,600

(22) Filed: Dec. 21, 2020

(65) Prior Publication Data

US 2021/0234272 A1 Jul. 29, 2021

(30) Foreign Application Priority Data

Jan. 23, 2020 (EP) ..... 20382038

(51) Int. Cl.
*H01Q 5/30* (2015.01)
*H01Q 5/40* (2015.01)
(Continued)

(52) U.S. Cl.
CPC ..... *H01Q 5/30* (2015.01); *H01Q 1/12* (2013.01); *H01Q 1/3241* (2013.01);
(Continued)

(58) Field of Classification Search
CPC ..... H01Q 5/30; H01Q 7/06; H01Q 5/307; H01Q 5/40; H01Q 1/3241; H01Q 1/12;
(Continued)

(56) References Cited

U.S. PATENT DOCUMENTS 7,616,166 B2 * 11/2009 Ueda ..... H01Q 1/3233 343/788
7,755,558 B2 * 7/2010 Ueda ..... H01Q 21/24 343/788
(Continued)

FOREIGN PATENT DOCUMENTS

EP 1552795 A1 7/2005
EP 2429033 A1 3/2012
(Continued)

OTHER PUBLICATIONS

Intellectual Property Office Notification of Reason for Refusal—10-2020-0187322 (dated Year: 2020).*
(Continued)

*Primary Examiner* — Vibol Tan
(74) *Attorney, Agent, or Firm* — Lucas & Mercanti, LLP

(57) ABSTRACT

A multiband 3D universal antenna having a magnetic core surrounded by a multiaxial coil wound around each of three orthogonal axis X, Y, Z, the multiaxial coil including at least two different coils wound around at least one of the three orthogonal axis; a support providing backing and/or isolation of the coils and a connection box connected to the external connectors providing a reconfigurable connection between the external connectors, so that several different antenna coil circuits are obtainable. Each coil of each axis has a specific cross section and a given number of turns and each coil is provided with two external connectors.

10 Claims, 3 Drawing Sheets

(51) Int. Cl.

| | |
|---|---|
| ***H01Q 7/06*** | (2006.01) |
| ***H01Q 5/50*** | (2015.01) |
| ***H01Q 1/12*** | (2006.01) |
| ***H01Q 1/32*** | (2006.01) |
| ***H01Q 5/307*** | (2015.01) |

(52) U.S. Cl.
CPC ..... *H01Q 5/307* (2015.01); *H01Q 5/40* (2015.01); *H01Q 5/50* (2015.01); *H01Q 7/06* (2013.01)

(58) Field of Classification Search
CPC .. H01Q 1/36; H01Q 1/50; H01Q 5/28; H01Q 5/50
See application file for complete search history.

(56) References Cited

U.S. PATENT DOCUMENTS 8,896,490 B2 * 11/2014 Miki ..... H01Q 7/06 343/788
8,907,760 B2 * 12/2014 Nowottnick ..... H01Q 5/35 340/5.2
9,153,855 B2 * 10/2015 Yamaguchi ..... H01Q 1/2283
9,647,340 B2 * 5/2017 Yagi ..... H01F 5/02
10,038,579 B1 7/2018 Muellner
10,505,278 B2 12/2019 Cobos Reyes et al.
10,707,565 B2 * 7/2020 Navarro Pérez ..... H01Q 7/08

FOREIGN PATENT DOCUMENTS

JP 2004153649 A * 5/2004
JP 4186149 B2 * 11/2008 ..... G06K 19/07756
WO 2014072075 A1 5/2014

OTHER PUBLICATIONS

3D Receptive Ultrathin LF Band Antenna—Kachiyasu Sato and Kazuhisa Sano (Year: 2014).*

* cited by examiner

MULTIBAND 3D UNIVERSAL ANTENNA

CROSS REFERENCE TO RELATED APPLICATION

This application claims the benefit of priority of European Patent Application No. 20382038.6, filed on Jan. 23, 2020, which is incorporated herein by reference.

TECHNICAL FIELD

The invention concerns to a multiband three-axis antenna, i.e. a passive component comprising at least one core and six windings arranged around three orthogonal axes of said core, in what follows termed 3D coil antenna for transponders/transceivers, particularly useful in the field of smart keys for cars and the like with a design optimized for being able to operate under different frequencies.

Currently, frequency is the first point that determines the choice of a 3D coil for PE/PS (Passive Entry/Passive Start) applications in the automotive sector. The three frequencies, within the low frequency communication, used in this area of use are: 125 kHz, 134.2 kHz and 20 kHz.

The 3D coil is part of the RFID communication transponder that is established between the car and the users key.

The purpose of this invention is to achieve a 3D coil antenna independent of the frequency or frequencies that a user will employ in an application.

This means to solve to comply with the minimum electrical parameters required for the work of the application at different frequencies in a small size that allows to use it in current designs and even miniaturize it for mobile applications.

The challenges are the internal and external connection of the different windings, the design of the core and the windings and the target external volume.

The advantage is a single transponder highly compact component capable of working with different chips or with a chip that can work with different frequencies and at high performance.

The problem to overcome is that the type of chip used in the application limits the choice of transponder or that to connect a chip that can work in the three frequencies it is necessary to connect it to two or three transponders with the cost that this would imply both economic and space in the application hardware.

In addition to this it is important to take into consideration and to be able to match the inductance range, the Q factor and the sensitivity of the antenna when operating under different frequencies.

STATE OF THE ART

For Passive Entry/Passive Start applications, a three-dimensional antenna comprising a 3D coil antenna as shown in WO2014072075, is required on the transponder side as an inductive receiver, so that the communication between the transmitter and receiver (transponder) is independent of the orientation in the receivers space. But this 3D coil antenna has only three windings orthogonally oriented in space that allow it to work in optimal conditions at a single frequency. Therefore, in order to be able to work at the three frequencies of the application, three 3D coils would be necessary, each one of them designed according to the frequency at which it is going to work in the application.

EP1552795 discloses a transponder with overlapping coil antennas on a common core in which several coils appear orthogonally oriented in the three main directions of space but with other applications different from those of receiving different frequencies In other known approaches the use of a 3D coil and a capacitor modulation is proposed, see as an example U.S. Pat. No. 10,038,579 but in this implementation the design of the coil at the working frequency is not optimized, it is only feasible to work with the same coil at different frequencies.

Other applications propose to use another frequency range as the high frequency NFC (Near Field Communication) together with UHF (Ultra High Frequency).

US10505278B2 (PREMO) discloses a three-axis antenna intended for other purposes with a high gain by an increase of the Q factor based on a special core on which three orthogonal coils are directly wind and each of said coils are separated in two coil portions by partitions walls of the own core. The proposed solution also provides miniaturization and space saving.

EP 2429033A1 discloses a multipurpose antenna assembly for remote access system comprising a package that includes a first coil antenna oriented in an X plane and configured to receive an (LF) signal having a carrier frequency between 30 kHz and 300 kHz, a second coil antenna oriented in a Y plane and configured to receive an (LF) signal having a carrier frequency between 30 kHz and 300 kHz, a third coil antenna oriented in the Z plane and configured to receive an (LF) signal having a carrier frequency between 30 kHz and 300 kHz and a fourth coil antenna oriented in the Z plane and configured to produce a high frequency (HF) signal having a carrier frequency between 3 MHz and 30 MHz.

BRIEF DESCRIPTION OF THE INVENTION

The design of the chips used for PE/PS (Passive Entry/Passive Start) applications in the automotive sector means that some features are required to be maximised compared to others in the design of the 3D Coil. Thus, the 125 kHz chips need to work with 3D coils that present a high S sensitivity while the 134.2 kHz chips get more performance from a high Q quality factor in the 3D coil. Chips at 20 kHz work with very high L inductances.

The invention to which this patent refers consists of a 3D coil that could work at all three frequencies covering the needs of the application. And everything would be integrated in a single SMD component. This would be very useful in order to integrate the PE/PS key of the car for example in mobile phones, making the system viable for the whole range of current cars independently of the mobile phone model.

Therefore, in a preferred embodiment it is proposed a 3D coil for an "universal chip" that can work at any frequency 22 kHz, 125 kHz, 134.2 kHz.

The proposed antenna is of small dimensions. So, for example the extension of the antenna in the X-axis and in the Y-axis, directions is preferably equal or less than 196 mm. As a preferred embodiment this size is 14 mm×14 mm. And the thickness of the antenna in the Z-axis direction is preferably equal or less than 1.65 mm.

The invention proposes a multiband 3D universal antenna of the above-mentioned small dimensions comprising:

- a magnetic core surrounded by a multiaxial coil wound around each of three orthogonal axis X, Y, Z, said multiaxial coil including at least two different coils wound around at least one or two of said three orthogonal axis;

a support providing backing and/or isolation of said coils, wherein each coil of each axis has a specific cross section and a given number of turns; and wherein each coil is provided with two external connectors; and a connection box connected to said external connectors of each coil configured to provide a reconfigurable interconnection between said external connectors, so that different external interconnections of the external connectors can be established by means of the connection box, and several different antenna coil circuits are obtainable.

The established different external interconnections are provided according to a specific:

given inductance range;

quality factor, Q, range;

sensitivity range to operate within at least three different working frequencies. In a preferred embodiment said multiaxial coil includes at least two different coils wound around each of said three orthogonal axis, each of the at least two coils differing in cross section and in number of turns.

That is to say, a 6-winding 3DC is proposed in which the 6 windings share a same core. For example, a ferrite core. Three windings are designed to work at the frequencies 125 kHz and 134.2 kHz and the other 3 windings designed to work at 20 kHz connected together so that the final component is an SMD pickup with only 8 pins.

The cited connection box provides said reconfigurable interconnection according to a specific-given inductance range, quality factor, Q, range and sensitivity range, to operate within at least the three different cited working frequencies.

In an embodiment the proposed multiband antenna is a receiver antenna, and the connection box is configured to respond to a given working frequency emitted in a nearby region.

Other features of the invention will appear from the following detailed description of an embodiment.

BRIEF DESCRIPTION OF THE FIGURES

The foregoing and other advantages and features will be more fully understood from the following detailed description of an embodiment with reference to the accompanying drawings, to be taken in an illustrative and non-limitative manner, in which.

DETAILED DESCRIPTION OF AN EMBODIMENT

Figure 1:
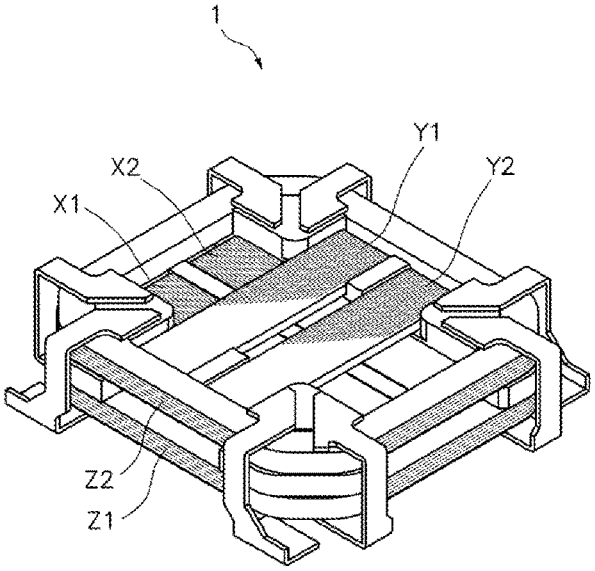
Fig.1 Prior Art
FIG. 1 shows a prior art of a 3D coil corresponding to an embodiment of cited US10505278B2 based on a special core on which three orthogonal coils are directly wind and each coil is separated in two coil portions by partitions walls of the own core.

To solve the problem posed for this invention there are needed at least 3 windings to work at 125-134 kHz and 3 windings to work at 20 kHz. The working frequencies are within a RFID band.

Requirements in terms of Q and sensitivity are quite different at these 3 frequencies. Current chips that work at 125 kHz suit coils with Qmin 15 but current chips that work at 134 kHz require a Qmin of 30. And at 20 kHz what it is required is a high inductance value to reach the sensitivity needs.

So, for 125 kHz and 134 kHz it will be the same three coils, but the goal is to achieve a Q of 30 min.

It has to be decided to provide separate connection for the 6 coils which means the need for-12 different contacts.

However same axis coils at 125 kHz and 20 kHz can share a pin that will be the end of the 125 kHz coil and the beginning of the 20 kHz coil, therefore 9 different contacts are needed.

It an alternative it can be also that the 6 coils share a ground connection and then there would be needed 7 different contacts.

It has to be decided also how to wind the coils: first both X windings, first X and Y windings at 125 kHz.

According to an embodiment the invention proposes a multiband 3D universal antenna that comprises:

a magnetic core surrounded by a multiaxial coil wound around each of three orthogonal axis X, Y, Z, said multiaxial coil including at least two different coils 12 wound around at least one of said three orthogonal axis;

a support providing backing and/or isolation of said coils 12, wherein each coil of each axis has a specific cross section and a given number of turns; and wherein each coil is provided with two external connectors 11; and a connection box 10 is connected to said external connectors 11 and is configured to provide a reconfigurable interconnection 16 between said external connectors 11, so that several different antenna coil circuits are obtainable.

According to a preferred embodiment the coils are spatially distributed to fit into a low-profile enclosure defining a height, length and a width where the height of the enclosure is less than twice the length and less than twice the width.

In case that in some axis there is only one winding instead of at least two, this would make that the 3Dcoil could work in 3 bands (20, 125 or 134.2 KHz) in the axes that have two windings and in one in which there is one.

And likewise, the proposal of this invention contemplates the case in which there is only one multiband axis.

However, in a preferred embodiment the multiaxial coil includes at least two different coils 12 wound around each of said three orthogonal axis, each of the at least two coils 12 differing in cross section and in number of turns.

Figure 2:
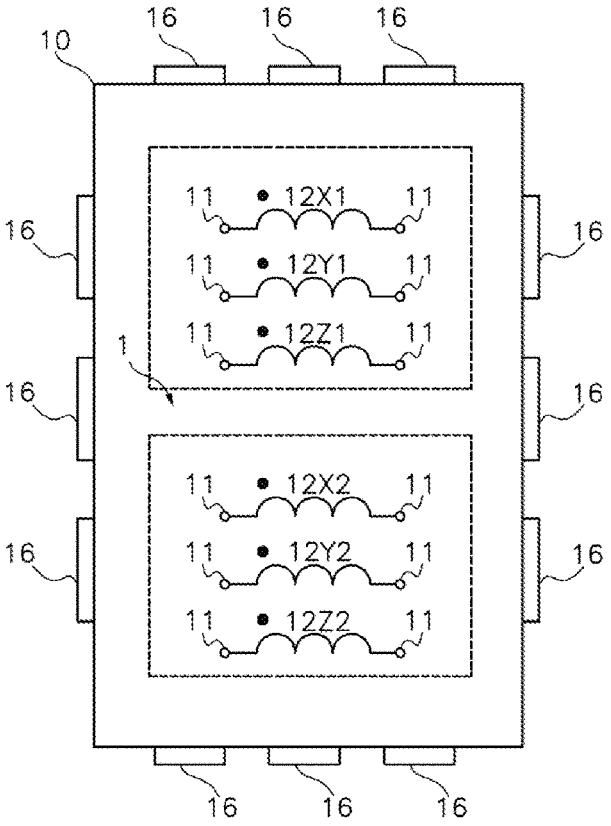
FIG. 2 schematically shows an embodiment of the proposed universal 3D coil with reconfigurable interconnection, arranged inside a connection box integrated circuit.
Figure 3:
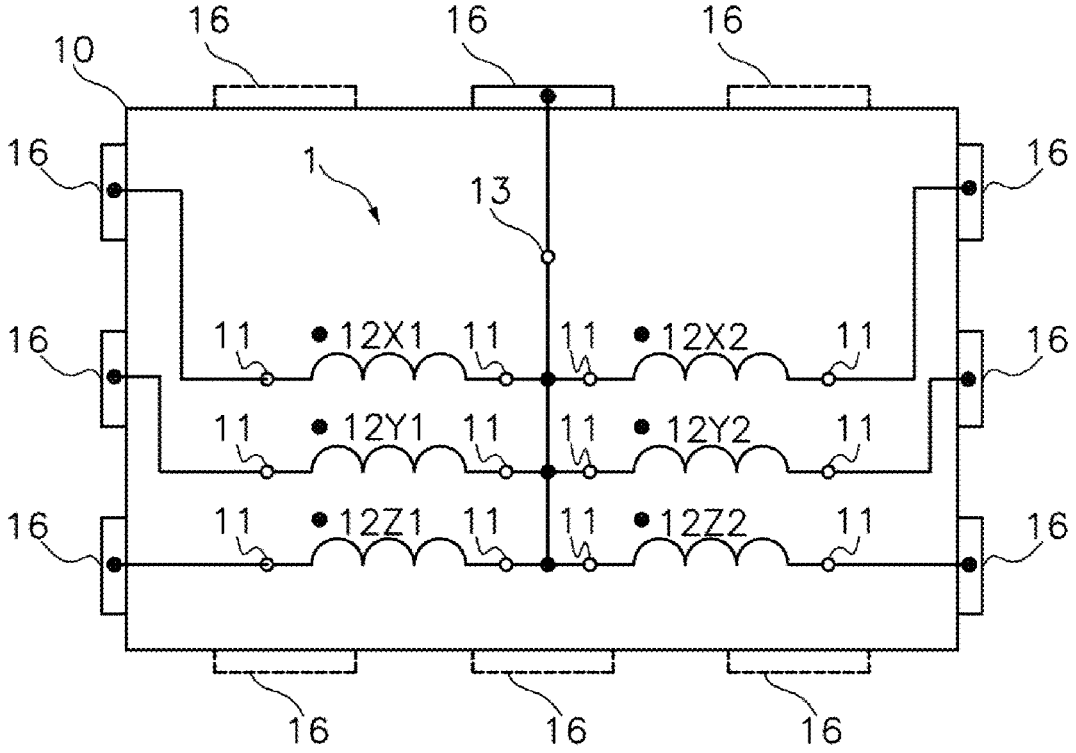
FIGS. 3, 4, 5 and 6 show some of the several possible embodiments of the antenna circuits according to a common ground, intermediate connections and combinations thereof, provided from the connection box.
Figure 4:
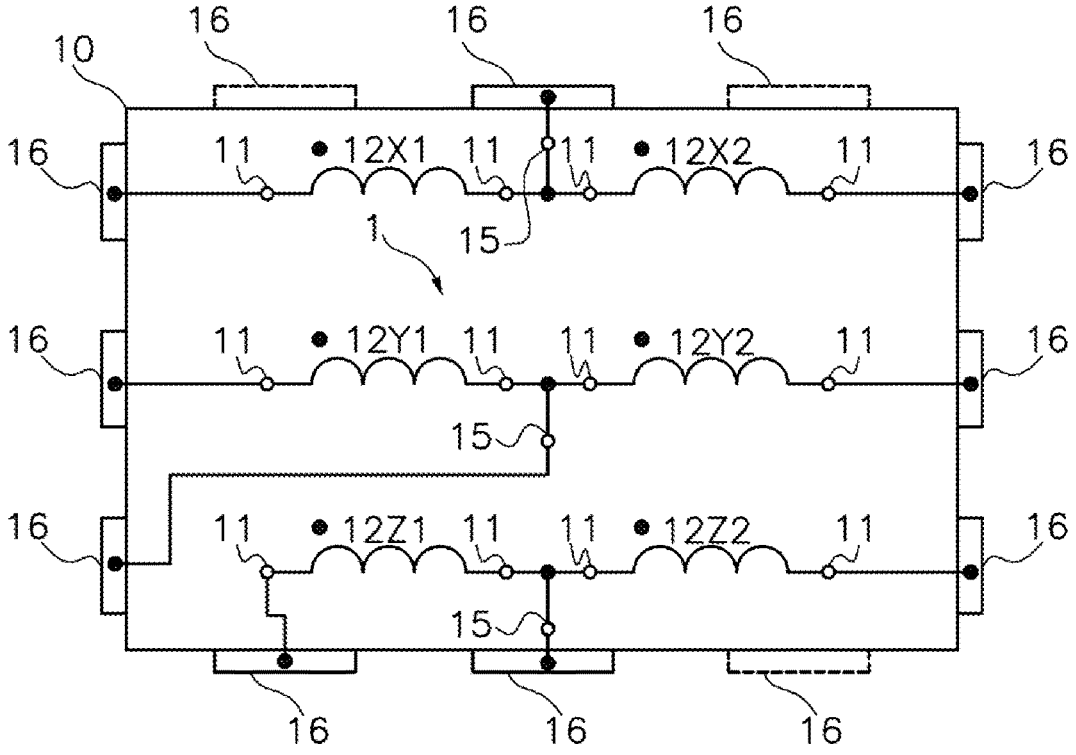
Figure 5:
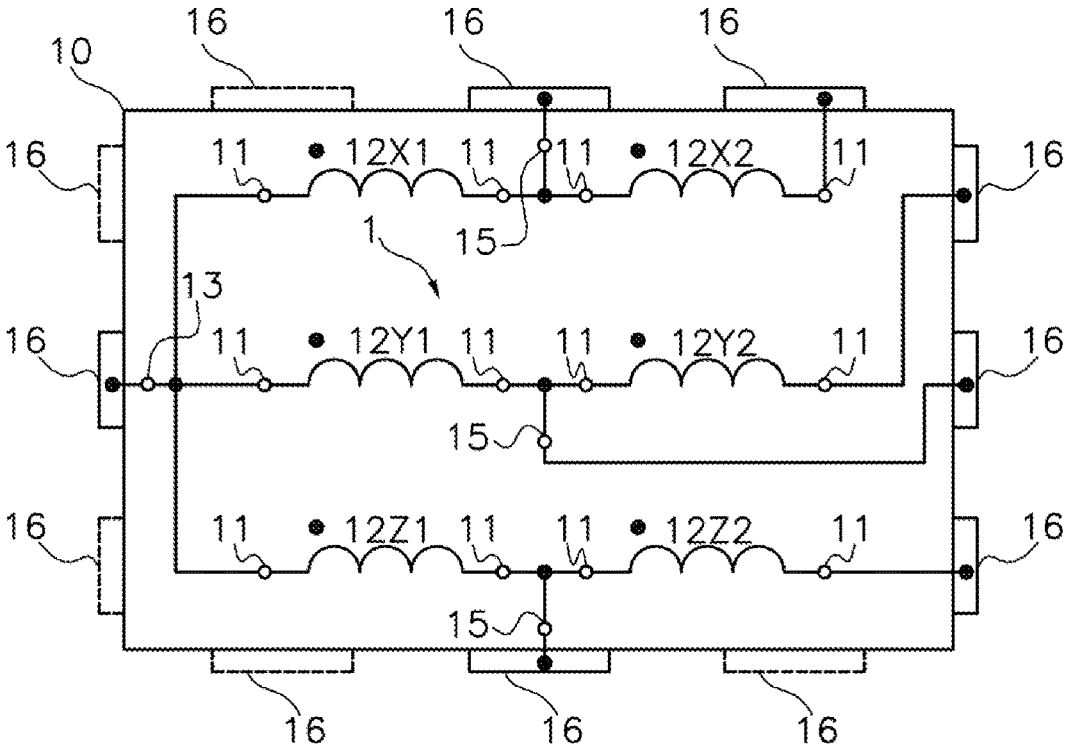
Figure 6:
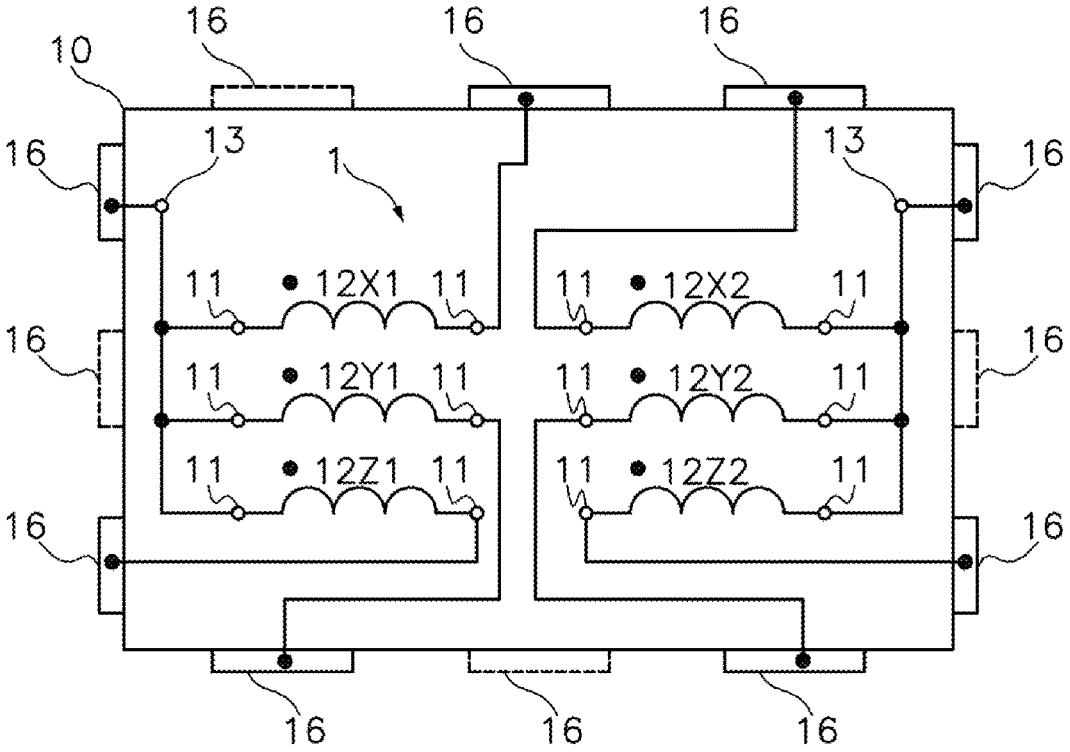

As illustrated in FIG. 2, the multiband antenna 1 is included within the connection box 10.

In a preferred embodiment the connection box 10 is an integrated circuit, IC.

As previously indicated the connection box 10 provides said reconfigurable interconnection 16 according to a specific:

given inductance range;

quality factor, Q, range;

sensitivity range to operate within at least three different working frequencies.

In an embodiment the multiband antenna 1 is a receiver antenna and the connection box 10 is configured to respond to a given working frequency emitted in a nearby region.

Some data of a specific embodiment are following detailed:

the given inductance range for a frequency of 20 kHz should be of 20 mH, for a frequency of 125 kHz or 134.2 kHz should be between 2.38 mH to 7.2 mH;

the quality factor, Q, for a frequency of 20 kHz should be over 3.5, for a frequency of 125 kHz should be over 15, and for a frequency of 134.2 should be over 30;

the sensitivity for a frequency of 20 kHz should be of 22 mV/A/m and for a frequency of 125 kHz or 134.2 kHz should be between 70 to 80 mV/A/m.

In the embodiments illustrated in FIGS. 3 to 6 six coils 12X1, 12X2, 12Y1, 12Y2, 12Z1 and 12Z2 and arranged around axis X, Y and Z, wherein coils 12X1, 12Y1 and 12Z1 have a cross section and number of turns configured to operate under the 125 kHz or 134.2 kHz frequency and wherein coils 12X2, 12Y2 and 12Z2 have a cross section and number of turns configured to operate under a 20 kHz frequency, said reconfigurable connection 16 involving the interconnection between some of the external connectors 11 of each of the six coils 12 according to at least the following different antenna coil circuits:

FIG. 3 an antenna coil circuit providing a common ground 13 to every coil 12X1, 12X2, 12Y1, 12Y2, 12Z1 and 12Z2 so that seven external connections 11 are established with the connection box 10.

FIG. 4:

an antenna coil circuit providing an intermediate connection 15 between the coils 12X1, 12X2, 12Y1, 12Y2, and 12Z1, 12Z2 of each axis, so that nine external connections 11 are established with the connection box 10.

FIG. 5 an antenna coil circuit providing a common ground 13 to a coil 12X1, 12Y1, 12Z1 of every axis and in addition an intermediate connection 15 between the coils 12X1, 12X2, 12Y1, 12Y2, and 12Z1, 12Z2 of each axis, so that seven external connections 11 are established with the connection box 10.

FIG. 6 an antenna coil circuit providing two distinct common grounds, a first common ground 13*a* shared by three coils 12X1, 12Y1, 12Z1 and a second common ground 13*b* shared by the other three coils 12X2, 12Y2, 12Z2 so that eight external connections 11 are established with the connection box 10.

The above different connection configurations should not be considered restrictive within the proposed solution of reconfiguring the interconnections of the different coils.

The invention also provides that around each axis there may be more than two coils.

According to different tests performed by the inventors it has been concluded that:

For Q reasons, it is better to wind in the following order: X1+Y1+X2+Y2+Z1+Z2.

With a common connection for every two windings it is reduced the number of pins from 12 to 9 but the Q factor decreases in a 15%. If we use common ground connection for the coil at 20 kHz (L2) the number of pins can be lowered from 9 to 8.

With a common ground connection for an option like the 4th it is reduced the number of pins from 12 to 7 but Q factor in x1 decreases in a 25% and sensitivity decrease is about 30%.

The best option that lowers the pin number 12 with a better Q compromise is a common connection for every two windings (125 kHz and 20 kHz); and a common ground connection for L2; refer to 6th sample.

These results are based on samples wound over a drum core shape of 11×11×3.75 mm.

It will be understood that various parts of one embodiment of the invention can be freely combined with parts described in other embodiments, even being said combination not explicitly described, provided there is no harm in such combination.

The scope of the present invention is defined in the following set of claims.

The invention claimed is:

1. A multiband 3D universal antenna system comprising:

a magnetic core surrounded by a multiaxial coil wound around each of three orthogonal axis X, Y, Z, said multiaxial coil including at least two different coils wound around at least one of said three orthogonal axis, each coil of each axis having a specific cross section and a given number of turns and each coil being provided with two external connectors;

a support configured to provide backing and/or isolation of said coils; and a connection box connected to said external connectors, said connection box configured to provide a reconfigurable interconnection between said external connectors, said reconfigurable interconnection configured to provide a given inductance range, quality factor (Q) range, and sensitivity range to operate within at least three different working frequencies, wherein the coils include six coils (12X1, 12X2, 12Y1, 12Y2, 12Z1 and 12Z2), which are arranged around axis X, Y and Z, three of said six coils (12X1, 12X2, 12Y1, 12Y2, 12Z1 and 12Z2) are configured to operate under a 125 kHz or 134.2 kHz frequency and three of said six coils (12X1, 12X2, 12Y1, 12Y2, 12Z1 and 12Z2) are configured to operate under a 20 kHz frequency.

2. The multiband antenna system according to claim 1, wherein said coils being are spatially distributed to fit into a low profile enclosure defining a height, length and a width where the height of the enclosure is less than twice the length and less than twice the width.

3. The multiband antenna system according to claim 1, wherein said multiband antenna is a receiver antenna and wherein said connection box is configured to respond to a given working frequency emitted in a nearby region.

4. The multiband antenna system according to claim 1, wherein said at least three different working frequencies are within a RFID band.

5. The multiband antenna system according to claim 1, wherein said given inductance range for a frequency of 20 kHz is 20 mH, and for a frequency of 125 kHz or 134.2 kHz is between 2.38 mH to 7.2 mH.

6. The multiband antenna system according to claim 1, wherein said quality factor, Q, for a frequency of 20 kHz is over 3.5, for a frequency of 125 kHz is over 15, and for a frequency of 134.2 kHz is over 30.

7. The multiband antenna system according to claim 1, wherein said sensitivity for a frequency of 20 kHz is 22 mV/A/m and for a frequency of 125 kHz or 134.2 kHz is from 70 to 80 mV/A/m.

8. The multiband antenna system according to claim 1, wherein the interconnections between the external connectors of each of the six coils are configured to provide said reconfigurable connection, so that a different set of external connector is selectable to the connection box, according to at least the following antenna circuits:

a common ground to every coil of said six coils (12X1, 12X2, 12Y1, 12Y2, 12Z1 and 12Z2);

an intermediate connection between the coils (12X1, 12X2), (12Y1, 12Y2), and (12Z1, 12Z2) of each axis;

a common ground to a coil (12X1, 12Y1, 12Z1) of every axis and in addition an intermediate connection between the coils (12X1, 12X2), (12Y1, 12Y2), and (12Z1, 12Z2) of each axis;

two distinct common grounds, a first common ground shared by three coils (12X1, 12Y1, 12Z1) and a second common ground shared by the other three coils (12X2, 12Y2, 12Z2).

9. The multiband antenna system according to claim 1, wherein the multiband antenna is included within the connection box.

10. The multiband antenna system according to claim 1, wherein said connection box is an integrated circuit (IC).

* * * * *